US007191853B2

(12) United States Patent
Maher et al.

(10) Patent No.: US 7,191,853 B2
(45) Date of Patent: Mar. 20, 2007

(54) HOLE CLEANING AND/OR FORMING TOOL

(76) Inventors: Graeme D Maher, 8 Long Street, Graceville, Queensland (AU) 4075; Edward A Kelly, 8 Long Street, Graceville, Queensland (AU) 4075

( * ) Notice: Subject to any disclaimer, the term of this patent is extended or adjusted under 35 U.S.C. 154(b) by 123 days.

(21) Appl. No.: 10/496,307

(22) PCT Filed: Nov. 25, 2002

(86) PCT No.: PCT/AU02/01589

§ 371 (c)(1),
(2), (4) Date: Jun. 2, 2004

(87) PCT Pub. No.: WO03/050360

PCT Pub. Date: Jun. 19, 2003

(65) Prior Publication Data

US 2005/0077088 A1 Apr. 14, 2005

(30) Foreign Application Priority Data

Dec. 12, 2001 (AU) ..... 200197192

(51) Int. Cl.
*E21B 10/00* (2006.01)

(52) U.S. Cl. ..... 175/327; 175/113

(58) Field of Classification Search ..... None
See application file for complete search history.

(56) References Cited

U.S. PATENT DOCUMENTS 934,029 A * 9/1909 West ..... 175/316
1,888,929 A * 11/1932 McDowell ..... 294/50.8
2,403,041 A * 7/1946 Leo ..... 173/140
2,710,765 A * 6/1955 Charles ..... 294/50.6
4,604,818 A * 8/1986 Inoue ..... 37/195
4,770,256 A * 9/1988 Lipsker et al. ..... 175/57
4,778,211 A * 10/1988 Gabriel ..... 294/115
4,848,484 A * 7/1989 Clements ..... 175/20
5,273,331 A * 12/1993 Burnham ..... 294/50.8
5,799,997 A * 9/1998 Lehn et al. ..... 294/55
6,068,315 A * 5/2000 Vaughter ..... 294/50.8
6,439,629 B1 * 8/2002 Bieth ..... 294/50.9

FOREIGN PATENT DOCUMENTS

| | | |
|---|---|---|
| DE | 2530531 | 1/1977 |
| FR | 2553127 | 4/1985 |
| SU | 1776728 | 11/1992 |

* cited by examiner

*Primary Examiner*—Zakiya W. Bates
(74) *Attorney, Agent, or Firm*—Hoffman, Wasson & Gitler

(57) ABSTRACT

A tool for cleaning and/or forming holes, the tool having a shaft, the shaft having a lower end and at least two buckets attached adjacent to the lower end of the shaft, each bucket having an open mouth which extends radially from the axis of the shaft, consequently rotation of the shaft about its axis causes rotation of the buckets, causing dirt to pass through the mouth of each bucket.

21 Claims, 5 Drawing Sheets

HOLE CLEANING AND/OR FORMING TOOL

FIELD OF THE INVENTION

This invention is directed to a hole cleaning tool and is particularly directed to a tool which can clean postholes dug by an auger. The invention is however not limited to this particular use. It is envisaged that the tool can also be used, if necessary with slight modification, to dig holes.

BACKGROUND ART

Postholes can be dug by hand, but are usually dug using an auger. The auger contains a steel shaft fitted with a peripheral spiral blade. Rotation of the auger causes the spiral blade to dig into the ground. The auger is typically rotated using a hydraulic motor that can be fitted to an excavator, a bobcat, or any other suitable powered device. It is however envisaged that certain augers can be manually rotated.

The auger digs into the ground to the desired depth and is then lifted out of the ground. This is achieved by raising the entire auger using a hydraulic ram. For instance, the auger may be coupled to a hydraulic motor, and the hydraulic motor may be coupled to the front lifting arms of a bobcat. When the auger has dug into the ground to the desired depth, the front arms of the bobcat are lifted to pull the entire auger out of the ground to form the posthole. Invariably, a quite considerable amount of the earth falls back into the hole upon removal of the auger.

Therefore, it is always necessary to clean out the formed postholes by removing the loose dirt that has fallen back into the hole. Typically, for smaller holes this is done by hand or using a small hand scoop. For larger and deeper holes a shovel is used, and it is known to have shovels with a relatively narrow shovel blade designed to clean out the deeper holes without damaging the hole profile. It is also known to provide a special hole cleaning device which comprises a pair of long arm scoops which are pivotally mounted to each other in an X type configuration. However, this tool is difficult to use and is not extremely efficient in scooping out loose dirt from a hole.

OBJECT OF THE INVENTION

It is an object of the invention to provide a tool that can be used to clean holes and which may at least partially overcome the above-mentioned disadvantages or provide the public with useful or commercial choice.

In one form, the invention resides in a tool for cleaning holes, the tool having a shaft, the shaft having a lower end, and at least two buckets attached to adjacent the lower end of the shaft, each bucket having an open mouth which extends radially from the axis of the shaft such that rotation of the shaft about its axis causes rotation of the buckets causing dirt to pass through the mouth of each bucket.

In this manner, the tool can be placed in the hole and can be turned, typically by about 180° to push dirt into each bucket. The tool can then be lifted out of the hole and the dirt can be shaken from each bucket. The action can then be repeated however many times are required in order to clean the hole.

Suitably, the buckets comprise a substantially flat bottom wall, a side wall, and the open mouth. It is preferred that the buckets have an open top to facilitate emptying of the dirt from the buckets and/or facilitate dirt passing into each bucket.

In a preferred form, each bucket is substantially U-shaped when viewed in plan. It is also preferred that the buckets are substantially identical relative to each other. It is further preferred that the open mouth of one bucket points in a direction which is substantially opposite to the open mouth of the other bucket.

It is envisaged that more than two buckets can be attached to the shaft. For instance, for larger holes three or even more buckets can be attached. If more than two buckets are attached, it is preferred that the buckets are angularly spaced substantially equally from each other. For instance, if three buckets are attached, the tool needs to be rotated by only 120° before the three buckets together define a full circle. Furthermore, if four buckets are attached, the tool needs to be rotated only by 90°.

By having the bottom wall of the buckets substantially flat, rotation of the tool is facilitated. Also, the bottom wall of the hole can be property cleaned.

The bottom wall may have a front edge that defines part of the mouth of the bucket. The front edge may be provided with profiles such as teeth to facilitate digging into the dirt. The front edge may be ramped to facilitate dirt passing through the mouth and into the main body of the bucket.

The height of each bucket may vary, and this can be varied by varying the height of the at least one side wall of each bucket. The higher each side wall is, the greater the carrying volume will be for each bucket. However, if the carrying volume is too great, it may be difficult to rotate the tool manually. It is envisaged that for manual rotation, the volume of each bucket should be between 200–2000 ml, which can enable each bucket to carry between say 200–3000 grams of dirt.

The tool need not be limited to manual rotation and one version of the invention allows the tool to be attached to a motor such as the hydraulic motor that drives the ground auger. Once a hydraulic motor is used, it is envisaged that the buckets can be made much larger and therefore able to scoop up much more dirt.

The tool may be formed of any suitable material, but it is envisaged that steel will be the desired material from which the tool is formed.

The shaft should have a length which will allow the buckets to pass entirely to the bottom of the hole while still having a shaft projecting from the hole. This will of course depend on the type of hole that is to be dug. It is envisaged that the shaft will have a length of between 1–3 m. It is also envisaged that the shaft is length adjustable and this can be achieved by various means including separate segments that can be attached to lengthen the shaft, a telescopic arrangement and the like.

Suitably, the lowermost portion of the shaft is provided with a point or other type of location device that can facilitate rotation of the shaft around its longitudinal axis when in the hole. The point can be pushed into the dirt at the bottom of the hole to act as a pivot to facilitate rotation of the tool.

Suitably, if a point or other type of location device is provided, it is removable with respect to the shaft. Thus, when the point is removed and the bottom of the tool is relatively flat, the tool can "wander" as it is rotated and this can facilitate cleaning out holes of diameters that are larger than the diameter of the tool. On the other hand, the tool can be designed to be "tuned" to a particular size auger. Thus, if the auger is used to form the post hole, the tool can then be inserted in the post hole and the tool will have the correct size to clean out the post hole and also if necessary to smooth the bottom wall and/or at least part of the side wall of the post hole.

If the hole is wet, there is a possibility that cleaning of the hole will produce a "suction effect" which can make it difficult to remove the tool from the hole. To avoid this, each bucket may be provided with small openings that can be placed in the back of each bucket.

To avoid the need to manufacture completely separate tools with different bucket sizes, it is envisaged that the buckets may be removably attached to the shaft or relative to the shaft. Therefore, the buckets can be made of various different sizes and can be attached to the shaft depending on the size of the hole etc. For instance, the buckets may be attached to a socket and this socket can be fitted to the bottom of the shaft.

The shaft may be formed or may have some form of coupling to allow it to couple to a hydraulic motor, a pneumatic motor, or any other type of suitable motor. The coupling may be in the form of a socket, a pin, and the like.

If the tool is to be turned manually, the top of the shaft may be provided with a laterally extending handle. The size and shape and type of the handle can of course vary to suit.

BRIEF DESCRIPTION OF THE DRAWINGS

Embodiments of the invention will be described with reference to the following drawings in which.

BEST MODE

Figure 1:
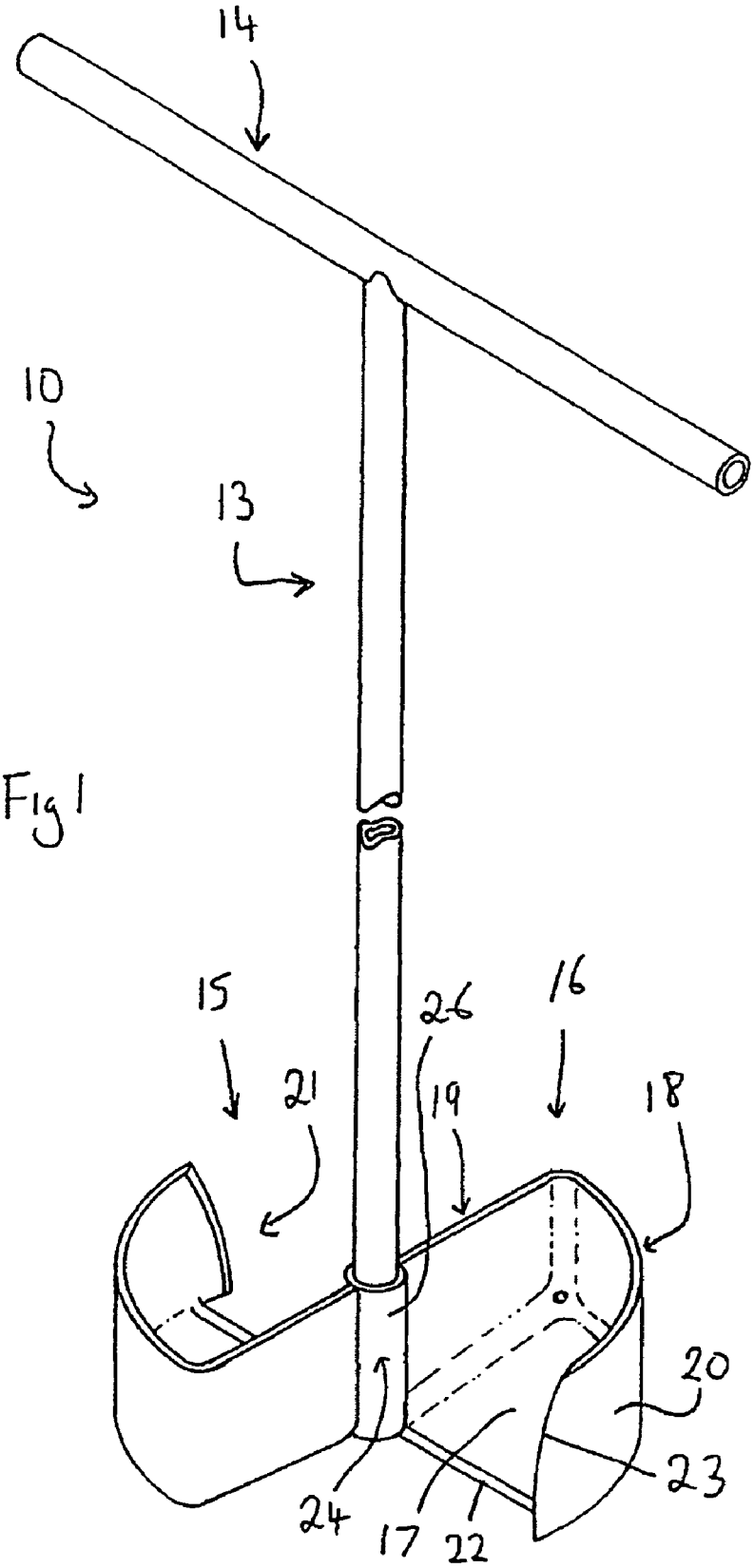
FIG. 1. Illustrates a manual tool according to an embodiment of the invention.

Referring to the drawings and initially to FIG. 1 there is illustrated a tool 10 for manually cleaning the bottom of a posthole.

The posthole 11 (see FIGS. 2, 3 and 4) is typically formed by being dug by an auger that is known. As the auger is pulled out of the hole, loose dirt 12 falls into the hole and needs to be removed.

Tool 10 has a shaft 13 which is formed of tubular steel and can have a length of between 1–3 m, or can even be length adjustable. The shaft has a diameter of between 20–50 mm although this can vary to suit. The shaft is turned manually and therefore has an upper handle 14 which comprises a transverse cylindrical steel tube which has a diameter of between 20–50 mm, and a length of between 60–150 cm although this can vary to suit. The handle is typically welded to the top of the shaft.

The bottom of the shaft contains two buckets 15, 16. The buckets are formed of steel and can have a wall thickness of between 2–5 mm. The buckets are substantially identical in configuration. Each bucket is substantially U-shaped when viewed in plan and has a relatively flat bottom wall 17, and a curved side wall 18. In the particular embodiment, the curved side wall is not entirely curved and has an initial radially extending flat portion 19 followed by a return curved portion 20. The top of the bucket is open. Each bucket has a mouth 21 which is defined by the front edge 22 of bottom wall 17, the side edge 23 of side wall 18, and the lower part 24 of shaft 13.

The mouth has a width of between 50–200 mm, and the side wall has a height of between 50–400 mm. For the manually turned tool as illustrated in FIG. 1, the volume of each bucket is such that the tool can still be relatively easily lifted from the post hole when the buckets are full. It is envisaged that the size of each bucket should be such that each bucket can hold a weight of between 1–5 kg. If the tool is to be rotated by a hydraulic motor, each bucket can of course be much larger and can hold between 5–20 kg. This can of course vary to suit.

The mouth of one bucket points in the opposite direction to the mouth of the other bucket, this being illustrated in FIG. 1. This means that rotation of the handle in one direction (in the clockwise direction with respect to the tool illustrated in FIG. 1) will cause each bucket to fill with dirt. If the tool has a pair of buckets as illustrated in FIG. 1, it is necessary to rotate the tool only by 180° to fill each bucket. Of course, the tool can contain three or more buckets (the larger number of buckets possibly being more suited for a motor driven tool). Of course, it is not necessary to limit the rotation of the bucket to 180°, and a bucket can be rotated further until such time as the buckets are full.

Each bucket is attached to shaft 13 via a lower socket 26. Thus, each bucket is attached to the socket typically by welding, and the socket can be press fitted over the lower end of shaft 13 and if necessary can be fixed by welds, a grub screw and the like. It is also envisaged that the socket can be removably fitted to the lower end of the shaft which means that the buckets can be removed and different sized buckets can be attached to the same shaft. For instance, the lower end of the shaft may be threaded and the internal bore of the socket may also be threaded such that the two parts can be threadingly attached. The arrangement of the threads should be such that rotation of the tool does not cause the socket to become detached from the shaft. Another arrangement envisages a "bayonet" type attachment. Other attachments are also envisaged. For instance, the buckets may be removably attached to the socket and this can be achieved by the use of pins and slots to allow each bucket to be pinned to the socket.

The front edge 22 is ramped to present a cutting edge to cut into the dirt. If desired, cutting teeth can be added to further assisting cleaning the hole.

Although the tool is designed primarily to clean holes, it is also envisaged that the tool can be used to form a hole. In this embodiment, the front edge 22 can be fitted with cutting teeth, or cutting teeth can be attached somewhere else and typically the teeth are projecting slightly downwardly.

Rotation of the tool either manually or by the motor will cause the teeth to dig into the ground. When the buckets are full, the tool can be removed and emptied and then placed back into the partially formed hole and again rotated to cause the hole to be further deepened. This procedure can be repeated many times to cause the hole to be dug and be cleaned at the same time.

Figure 2:
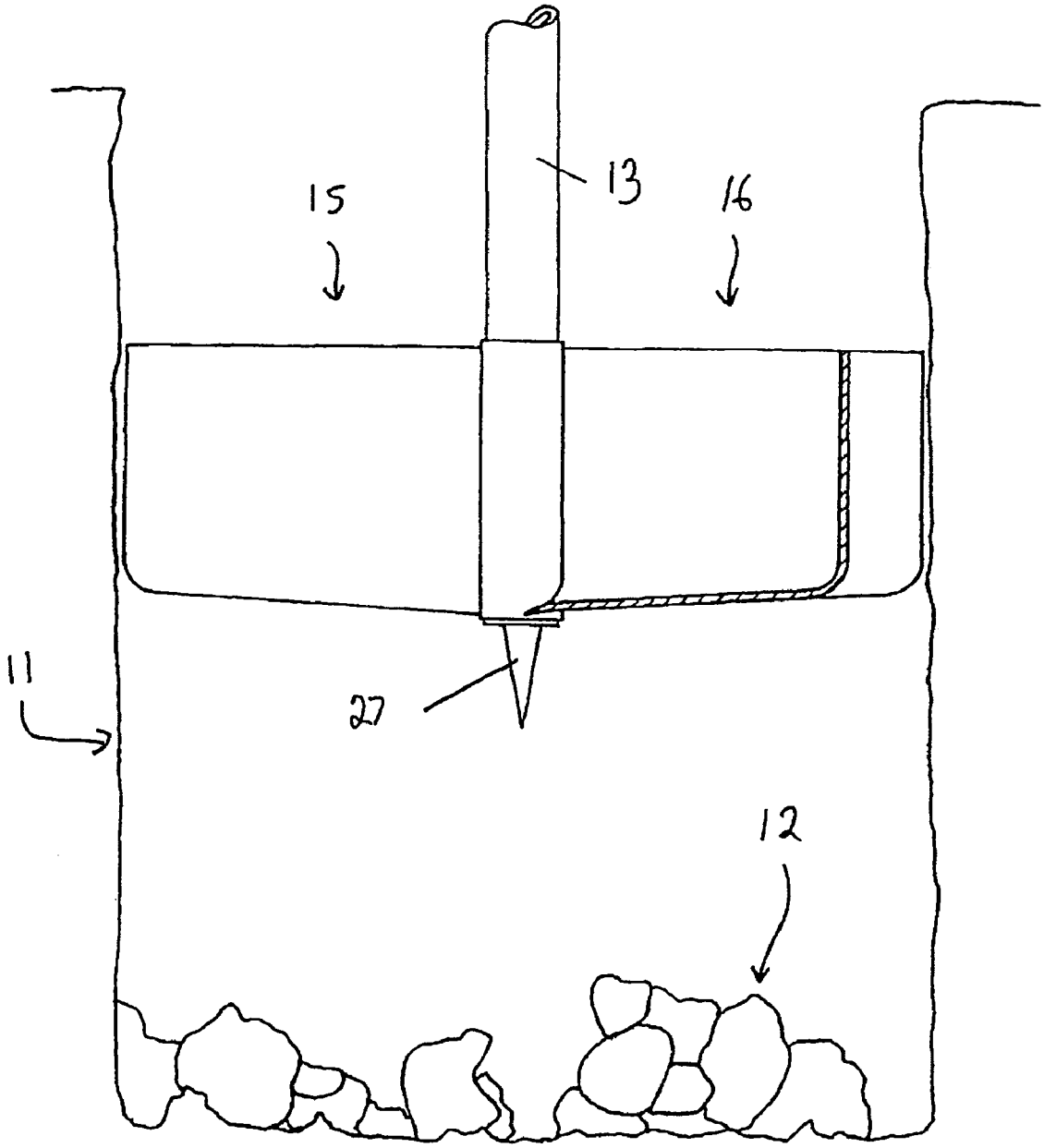
FIG. 2. Illustrates the lower end of the tool of FIG. 1 being inserted into a hole containing loose dirt.

Referring to FIG. 2, the lower end of the tool 10 is illustrated. In this figure, it can be seen that a lowermost end of shaft 13 is provided with a spike 27 that is pushed into the bottom of the hole and functions as a rotating pivot to assist in rotation of the tool. Also evident from FIG. 2 is that the tool is preferably sized such that the width of the tool is about the same as the width of the hole. This allows the tool to clean the hole and to smooth the sides of the hole. It is however envisaged that spike 27 can be removed and the tool can then be used in a hole that has a diameter that is considerably larger than the width of the tool. As the tool is turned, it "wanders" about the bottom of the hole to facilitate cleaning.

Figure 3:
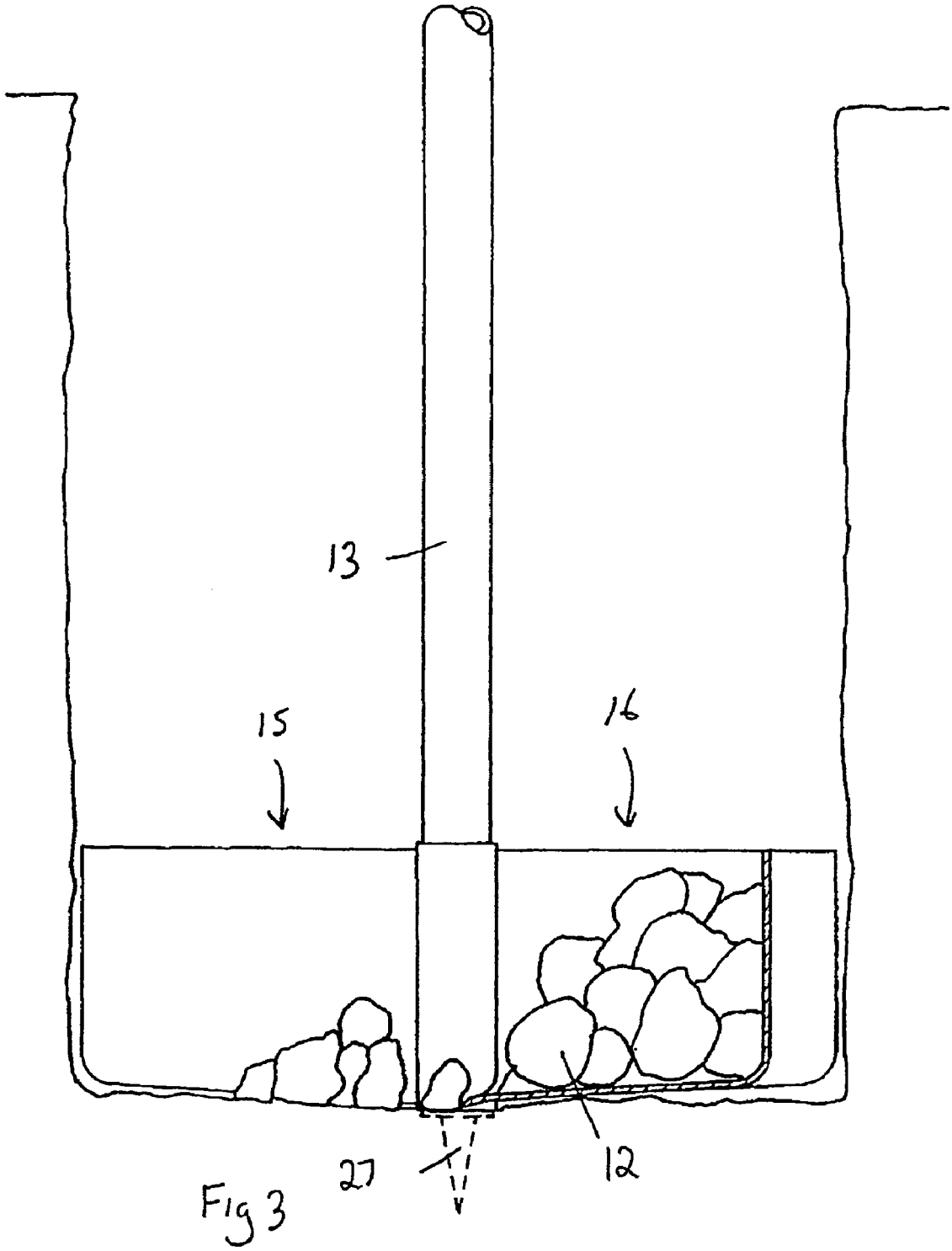
FIG. 3. Illustrates the lower end of the tool of FIG. 1 at the bottom of the hole.

Referring to FIG. 3, the tool is now in the bottom of the hole and rotation of the tool causes dirt 12 to pass into the buckets 15, 16.

Figure 4:
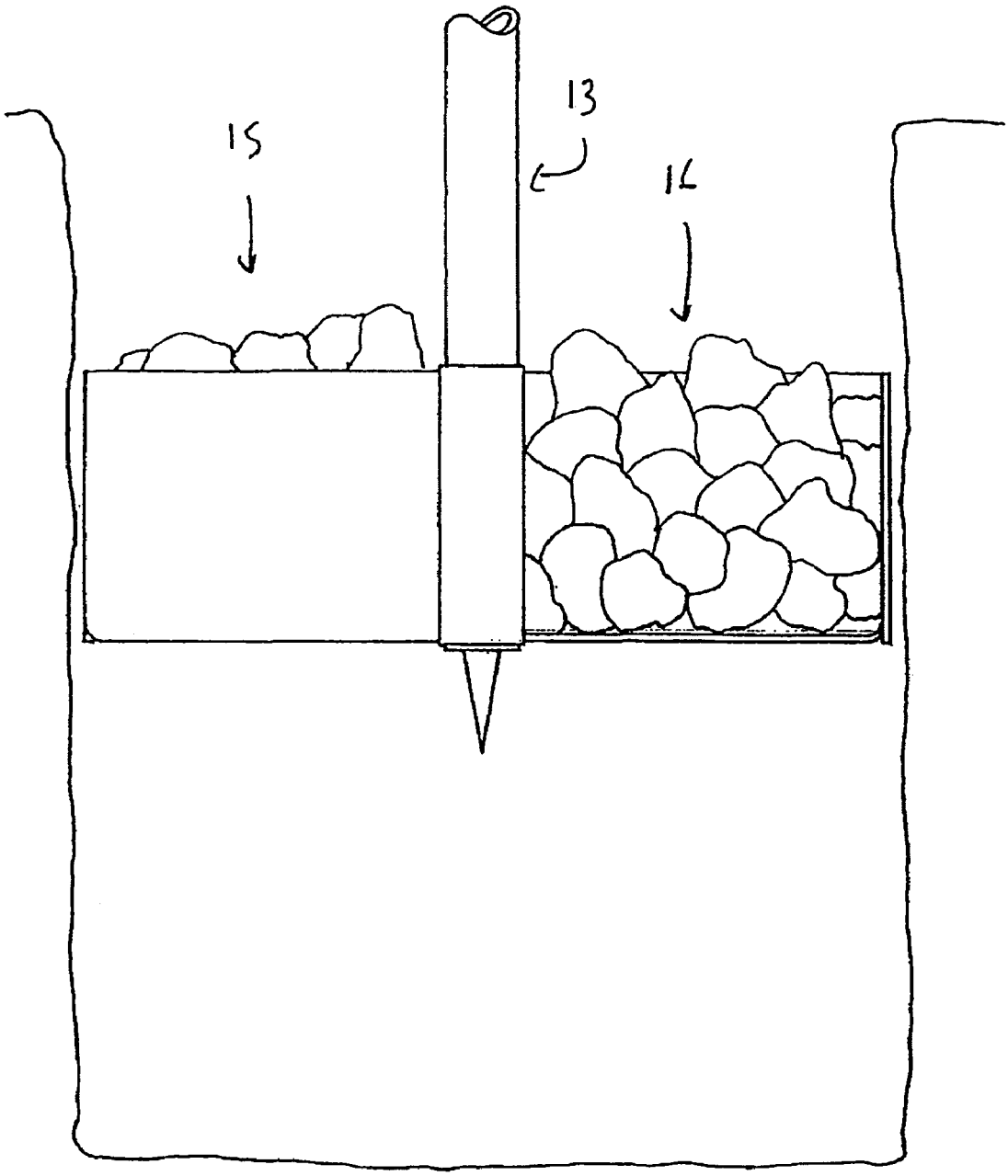
FIG. 4. Illustrates the tool being raised from the bottom of the hole.

Referring to FIG. 4, the tool has been rotated and the dirt has filled the buckets, and as the tool is being lifted out of the hole, it will carry the dirt with it to present a clean hole.

Figure 5:
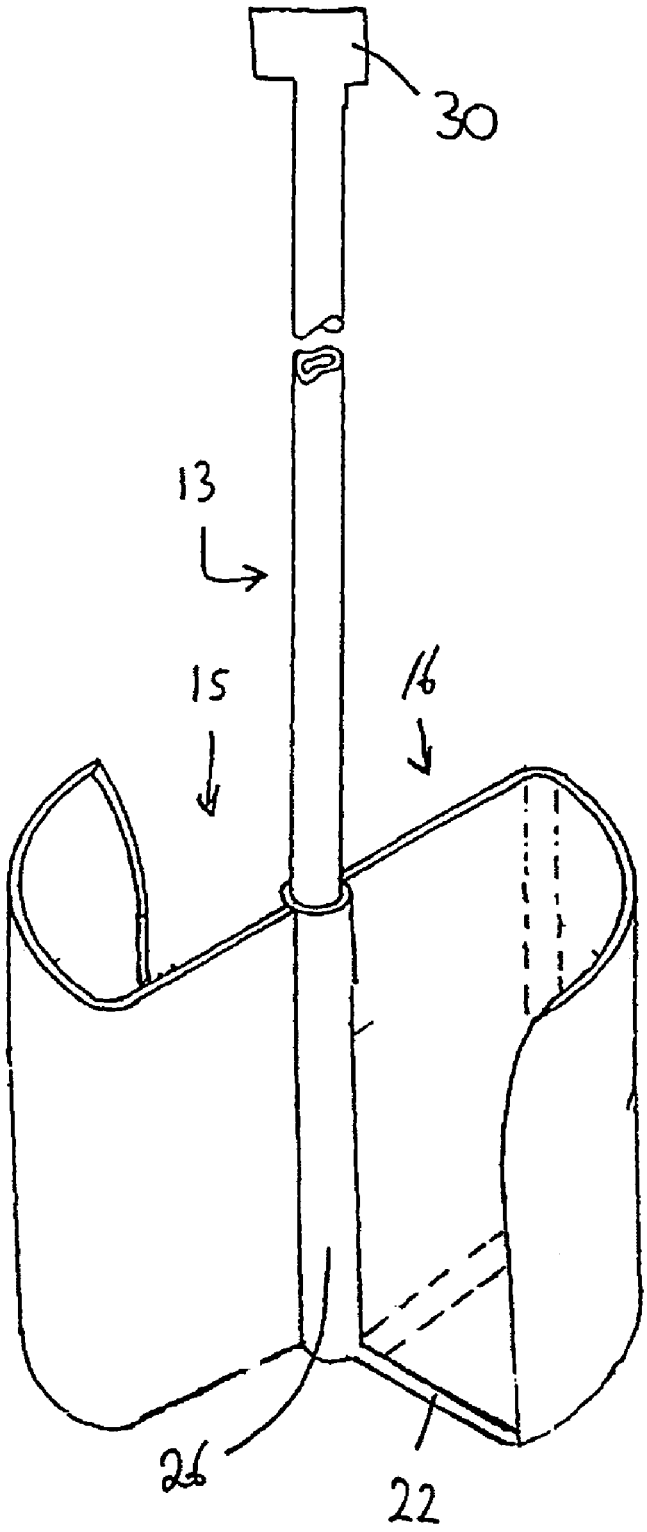
FIG. 5. Illustrates a tool having much larger buckets and suitable for use with a hydraulic motor as opposed to manual rotation.

FIG. 5 illustrates an embodiment of the invention where the buckets are much larger in volume thereby making the tool suitable for attachment to a motor which is much more powerful than manual turning. Some form of attachment, such as a socket 30, is on the top of shaft 13 to allow the tool to be attached to a motor that is typically the hydraulic motor previously used to power the digging auger.

It should be appreciated that various other changes and modifications can be made to the embodiments described without departing from the spirit and scope of the invention as claimed.

The invention claimed is:

1. A tool for cleaning and/or forming holes, the tool having a shaft, the shaft having a lower end, and at least two buckets attached to adjacent to the lower end of the shaft, each bucket having a substantially flat bottom wall, a side wall, and an open mouth which extends radially from the axis of the shaft, whereby rotation of the shaft about its axis causes rotation of the buckets causing dirt to pass through the mouth of each bucket.

2. The tool as claimed in claim 1, wherein the buckets have a substantially flat bottom wall, a side wall, and the open mouth.

3. The tool as claimed in claim 1, wherein the buckets have an open top to facilitate emptying of the dirt from the buckets and/or facilitate dirt passing into each bucket.

4. The tool as claimed in claim 1, wherein each bucket is substantially U-shaped when viewed in plan.

5. The tool as claimed in claim 1, wherein the buckets are substantially identical relative to each other.

6. The tool as claimed in claim 1, wherein the open mouth of one bucket points in a direction that is substantially opposite to the open mouth of the other bucket.

7. The tool as claimed in claim 1, wherein more than two buckets are attached to the shaft.

8. The tool as claimed in claim 1, wherein the bottom wall has a front edge that defines part of the mouth of the bucket.

9. The tool as claimed in claim 8, wherein the front edge is provided with profiles such as teeth to facilitate digging into the dirt.

10. The tool as claimed in claim 8, wherein the front edge is ramped to facilitate dirt passing through the mouth and into the main body of the bucket.

11. The tool as claimed in claim 1, wherein the tool is rotated manually and has a handle to rotate the tool.

12. The tool as claimed in claim 11, wherein the volume of each bucket is between 200–2000 $cm^3$.

13. The tool as claimed in claim 1, wherein the tool is rotated using a motor.

14. The tool as claimed in claim 13, wherein the shaft has a coupling to couple the shaft to the motor.

15. The tool as claimed claim 14, wherein the shaft has a length of between 1–3 m.

16. The tool as claimed in claim 15, wherein the shaft is length adjustable.

17. The tool as claimed in claim 14 wherein the shaft has a lowermost portion which is provided with a point or other type of location device that facilitates rotation of the shaft around its longitudinal axis when in the hole.

18. The tool as claimed in claim 17, wherein the point is removably attached to the shaft.

19. The tool as claimed in claim 1, wherein apertures are formed in the side wall of each bucket.

20. The tool as claimed in claim 1, wherein the buckets are removably attached relative to the shaft.

21. The tool as claimed in claim 1, wherein the buckets are attached to a socket, and the socket is attached to the shaft.

* * * * *